United States Patent [19]

Spathis et al.

[11] Patent Number: 4,528,217

[45] Date of Patent: Jul. 9, 1985

[54] ADJUSTABLE PULL BOW

[75] Inventors: George Spathis, Deerfield, Ill.; Anita C. Korrasik, Glen Head, N.Y.

[73] Assignee: Clevepak Corporation, Purchase, N.Y.

[21] Appl. No.: 652,308

[22] Filed: Sep. 19, 1984

[51] Int. Cl.[3] ..... D04D 7/10

[52] U.S. Cl. ..... 428/5; 223/46; 289/1.2; 289/1.5

[58] Field of Search ..... 223/46; 289/1.2, 1.5; 428/4, 5

[56] References Cited

U.S. PATENT DOCUMENTS

| | | | |
|---|---|---|---|
| 1,598,310 | 8/1926 | Quinlan | 428/5 X |
| 3,223,440 | 12/1965 | Rosenzweig | 428/5 X |
| 3,307,864 | 3/1967 | Rosenzweig | 428/5 X |
| 3,612,587 | 10/1971 | Rubin | 289/1.2 |

*Primary Examiner*—Henry F. Epstein
*Attorney, Agent, or Firm*—Janet C. Lentz

[57] ABSTRACT

A pre-tied bow having an outer loop which can be adjusted to fit around a package and the method for making the same. The bow is made from a single piece of flexible material and comprises (1) a bow portion having right and left bow loops, a center knot, an adjustable tail, and a stationary tail and (2) an adjustable loop portion. The method of fabricating the bow comprises (1) tying the bow portion, (2) bringing the adjustable tail into a loop centered on the bow portion, and (3) tying the stationary tail around the bow portion and adjustable tail to form the center knot. The size of the adjustable loop can be varied to fit securely around a package by pulling the adjustable tail through the center knot. The excess length of the adjustable tail can be cut to match the length of the stationary tail.

6 Claims, 11 Drawing Figures

ADJUSTABLE PULL BOW

TECHNICAL FIELD OF THE INVENTION

This invention relates to bows and to methods for tying bows, and more particularly, to a pre-tied bow having an outer loop which can be adjusted to fit around a package.

BACKGROUND OF THE INVENTION

Ribbon used for gift-wrapping packages typically is available in the form of a roll. The ribbon is withdrawn from the roll to a desired length, cut, and formed around the package. The ribbon ends are tied once and then tied again to form a knot. The ribbon ends can then be tied into a bow. Very often however, it is difficult for one person to tie the ribbon into a knot around the package in a secure manner without the help of a second person. This is because two hands of a first person are needed to hold the ends of the ribbon apart after the ribbon ends are tied the first time. A second person must hold a finger at the point where the ribbon ends cross while the first person ties the ribbon ends into a knot. Even when two people cooperate in this manner to form a knot, the ribbon may not fit securely around the package because the second person must release his finger before the knot can be completed. Additionally, it may be difficult for a person to form a neatly tied bow of a desired shape and proportion.

SUMMARY OF THE INVENTION

It is therefore an object of the present invention to provide a convenient means for securing a ribbon and neatly tied bow around a package.

According to the present invention, an adjustable pull bow, made of a single length of flexible material, is provided and comprises a bow portion and an adjustable loop portion, the bow portion comprising a right bow loop and a left bow loop, a center knot between the right and left bow loops, a stationary bow tail, and an adjustable bow tail wherein the adjustable loop portion can be varied in size by pulling the adjustable bow tail through the center knot of the bow portion. The method for making the bow comprises the steps of:

(a) tying the stationary and adjustable tails to form the bow portion;

(b) bringing the adjustable tail into a loop centered on the bow portion; and (c) bringing the stationary tail around the bow portion and the adjustable tail to form the center knot such that the adjustable tail can be moved through the center knot allowing the size of the adjustable loop to be varied. The adjustable loop portion of the adjustable pull bow of the present invention can be placed around a package in a desired orientation. By pulling on the adjustable tail, the adjustable loop can be securely adjusted to fit around the package. The adjustable ribbon tail can then be trimmed to match the length of the stationary ribbon tail or to another desired length.

DETAILED DESCRIPTION OF THE INVENTION

Figure 10:
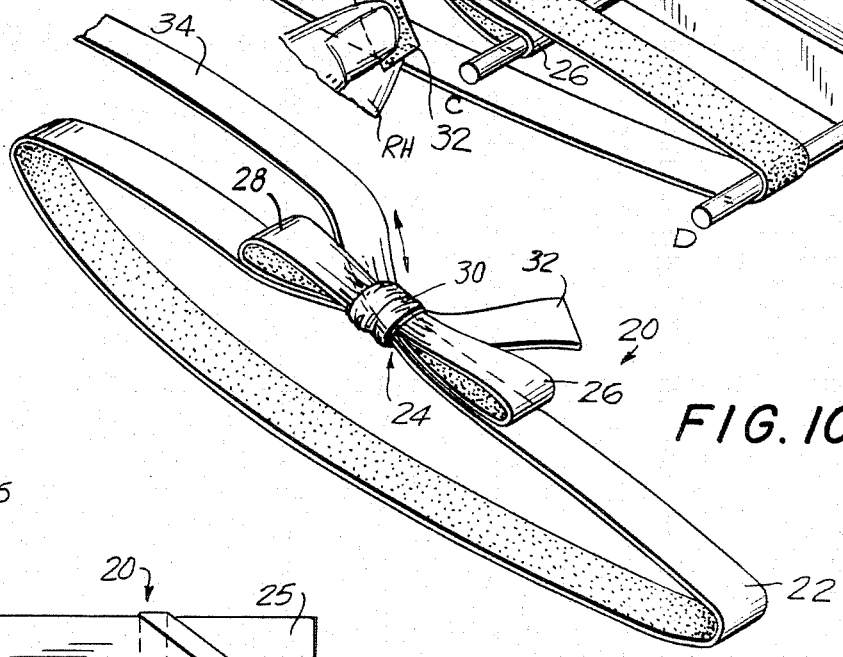
FIG. 10 is a perspective view of the finished bow according to the present invention.

The adjustable pull bow of the present invention, generally indicated as 20, is shown in FIG. 10. The bow comprises an adjustable outer loop 22 and a bow portion 24. The bow portion 24 comprises a right loop 26, a left loop 28, a center knot 30, a stationary or right ribbon tail 32, and an adjustable or left ribbon tail 34. Although the invention will be described below with the right hand side as being the stationary ribbon tail and the left hand side as being the adjustable ribbon tail, the left hand side could be made stationary and the right hand side could be made adjustable by substituting the left hand tail for the right hand tail and the right hand tail for the left hand tail in the method described below for constructing the bow 20 of the present invention.

Figure 11:
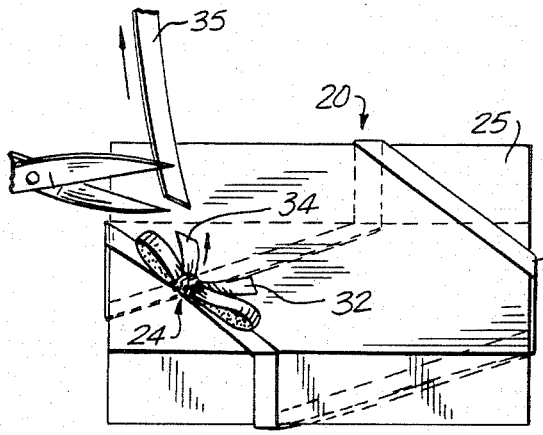
FIG. 11 shows the bow formed around a package with a ribbon tail being cut away to even out the ribbon tails.

FIG. 11 shows an example of the bow 20 in use. The adjustable outer loop 22 and bow portion 24 are placed in the desired configuration around a package 25. By pulling the left ribbon tail 34, the adjustable loop 22 can be tightened around the package. Any excess length 35 on the left ribbon tail 34 created when the adjustable loop 22 is tightened around the package can be trimmed to match the length of right ribbon tail 32, as shown in FIG. 11, or to another desired length.

Figure 1:
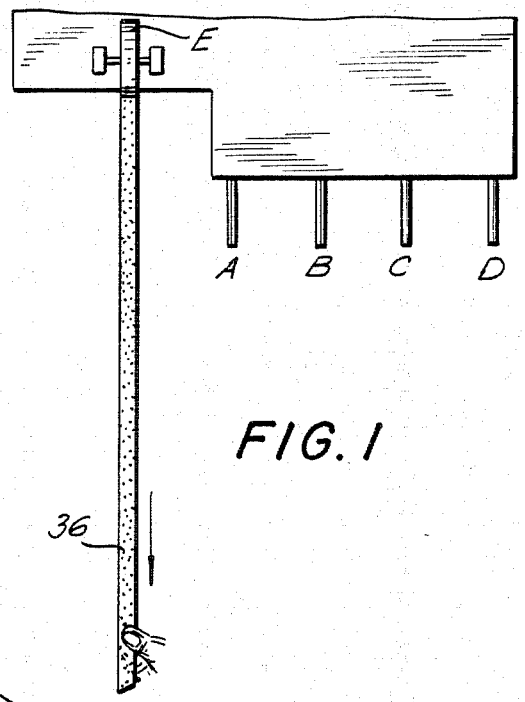
FIG. 1 shows a top view of a device which can be used to assist in making the bow of the present invention.

When fabricating bows according to the invention, a suitable jig or fixture, such as that shown in FIG. 1, having pins A, B, C, and D can be used. The pins can be adjustable for forming various sizes of bow loops 26 and 28 and the adjustable outer loop 22. A roll of ribbon E can be affixed on or close to the jig to provide a convenient supply of ribbon 36. The ribbon 36 can have a rough or unfinished surface, shown in the figures as dotted surfaces, and a finished or smooth surface, shown as non-dotted surfaces of the ribbon 36. Of course, ribbon 36 could have both sides finished.

Figure 2:
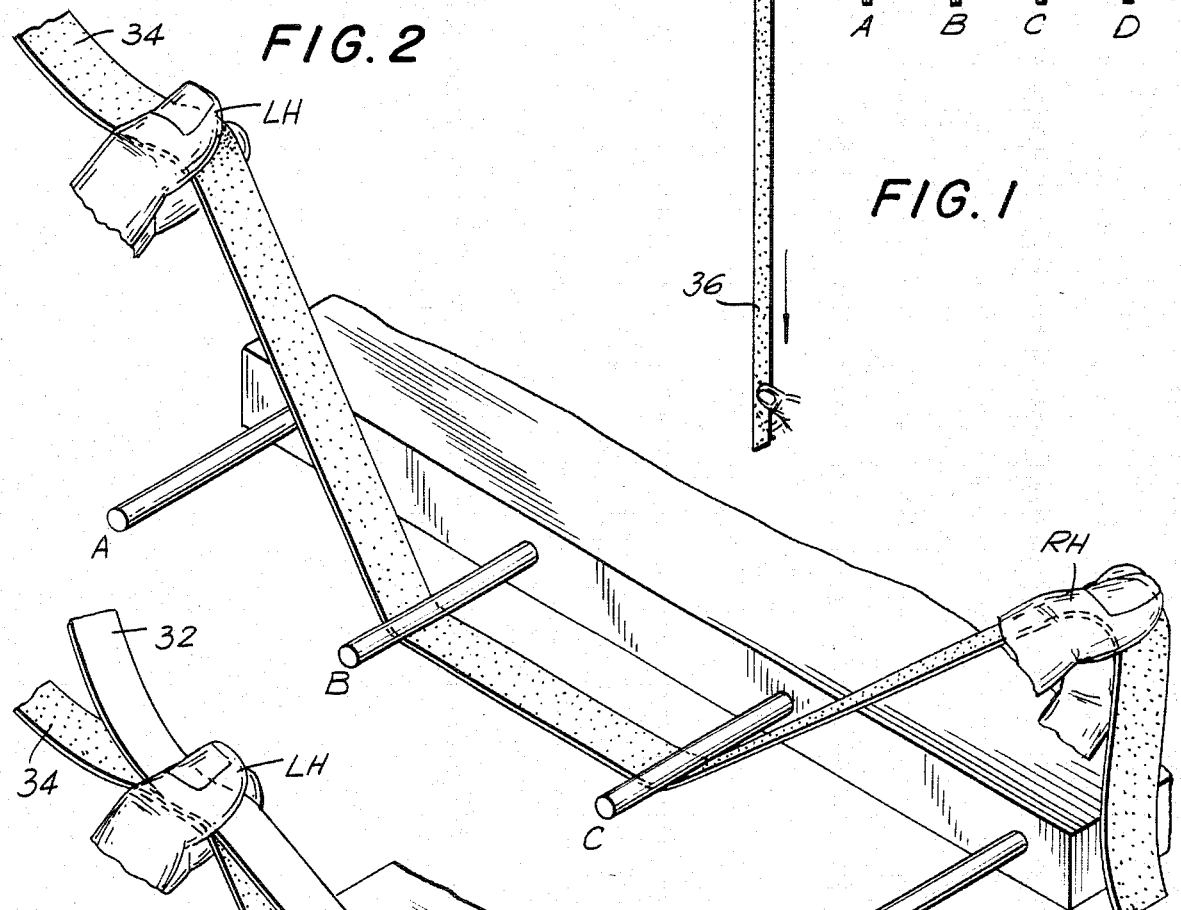
FIGS. 2 to 9 are perspective views of sequential steps illustrating a preferred method of constructing the bow according to the invention.

FIGS. 2–9 show in sequential steps a preferred method for fabricating the adjustable pull bow 20. FIG. 2 shows a length of ribbon 36, rough side facing up, placed under middle pins B and C of the jig. Ribbon 36 is held by the right hand (indicated by RH in the figures) at right ribbon tail 32 and by the left hand (indicated by LH in the figures) at left ribbon tail 34. The left ribbon tail 34 can either remain uncut from the supply roll E or can be cut to a pre-determined length for completion of bow 20.

Figure 3:
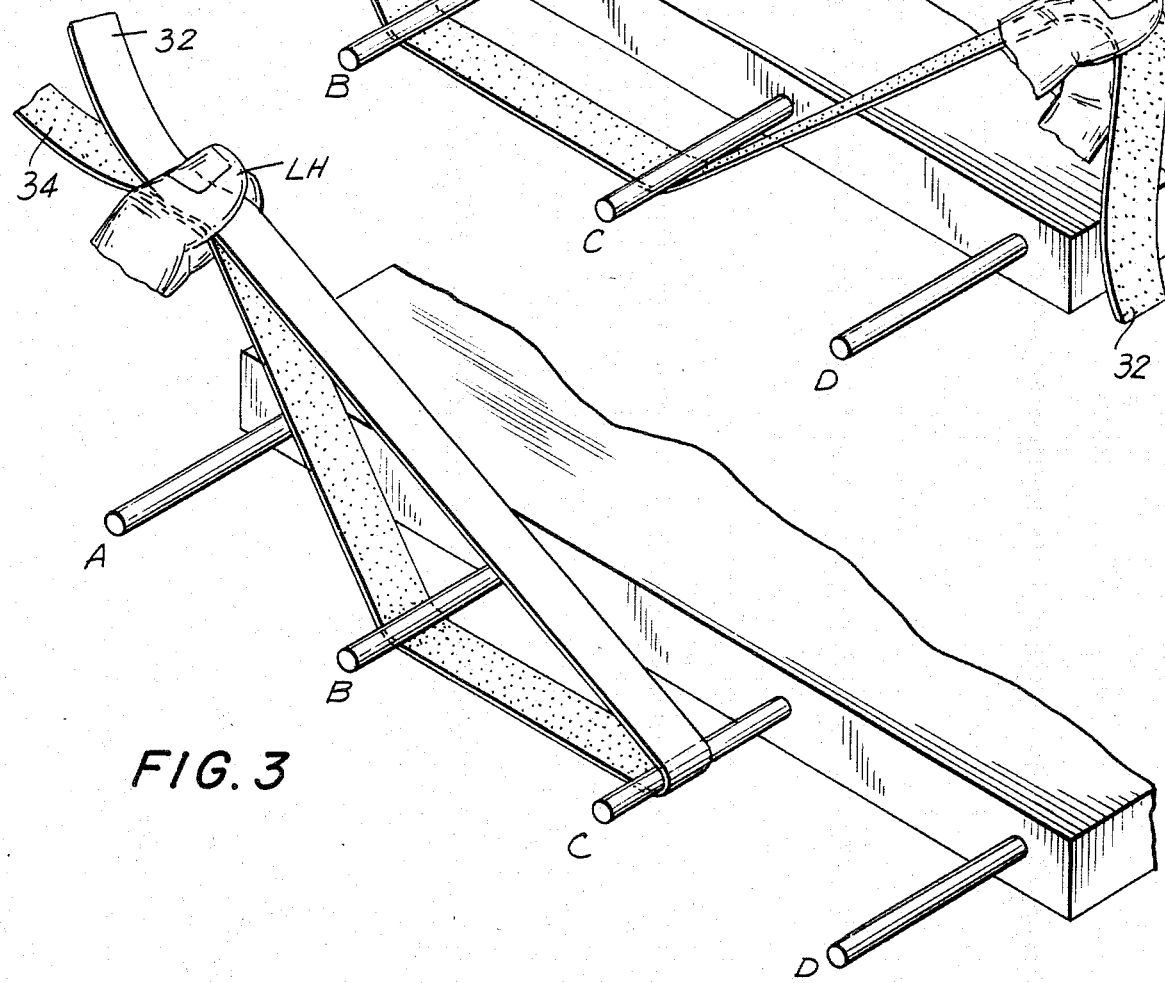
Figure 4:
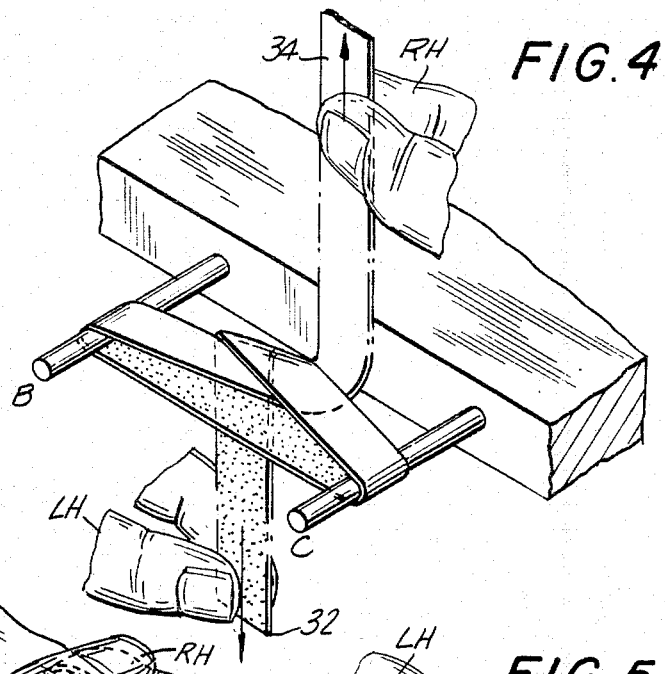
Figure 6:
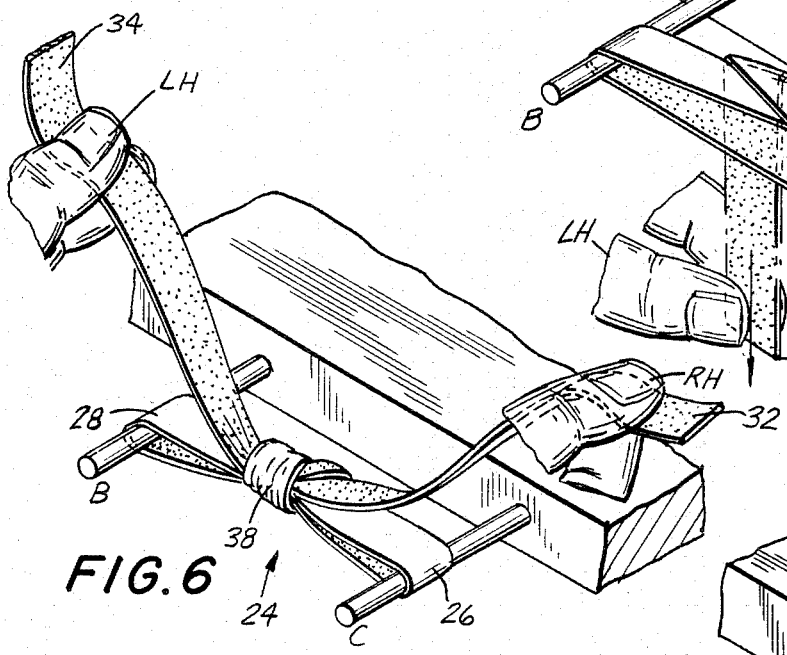
Figure 5:
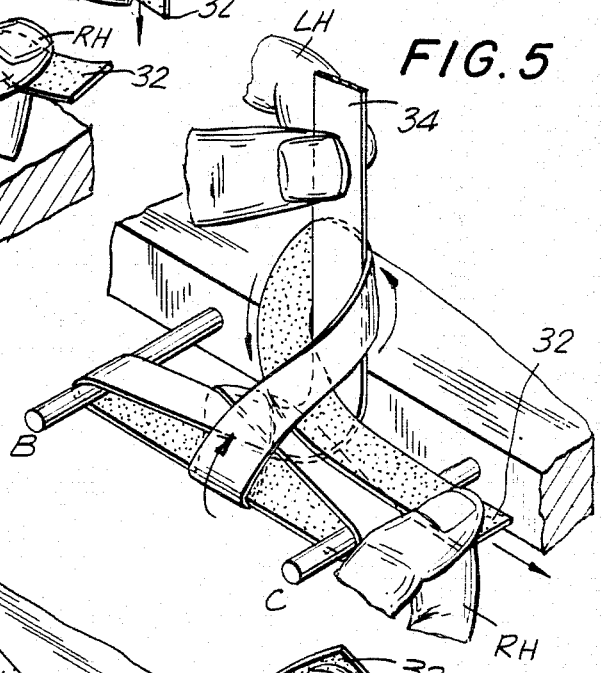

FIG. 3 shows the right and left ribbon tails 32 and 34 being held together by the left hand in preparation for the tying operation illustrated in FIGS. 4–6 for forming a bow knot 38.

In FIG. 4, the right ribbon tail 32, being held by the left hand, is crossed over the left ribbon tail 34, being held by the right hand, and behind both the left ribbon tail and the portion of ribbon 36 extending under pins B and C. At this point, the smooth side of left ribbon tail 34 and the rough side of right ribbon tail 32 are facing the person tying the bow.

In FIG. 5, the bow knot 38 is formed by bringing right ribbon tail 32 to the right of and behind left ribbon tail 34 and then back under the right ribbon tail 32, i.e., through the loop created when right ribbon tail 32 was brought up and around left ribbon tail 34.

As shown in FIG. 6, when the right and left ribbon tails 32 and 34 are pulled tight, bow knot 38, located equidistant between pins B and C, is formed. Bow knot 38 now defines right and left loops 26 and 28 of bow portion 24.

Figure 7:
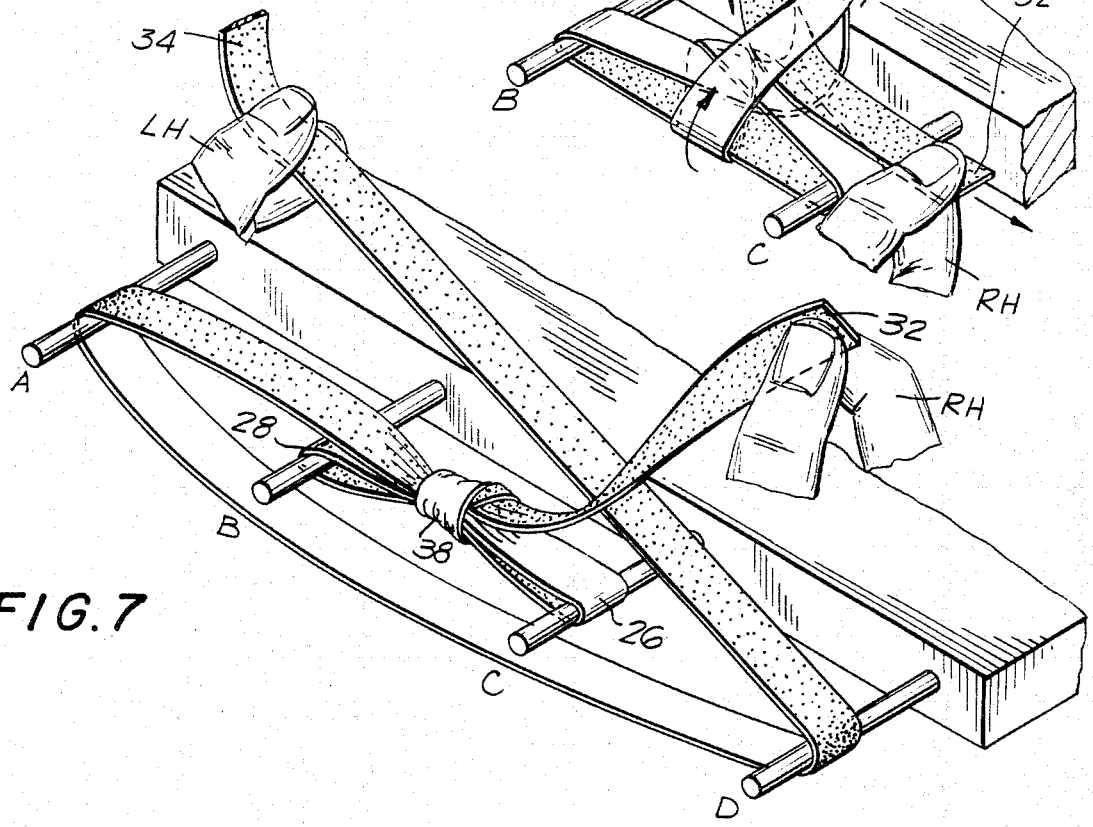
Figure 8:
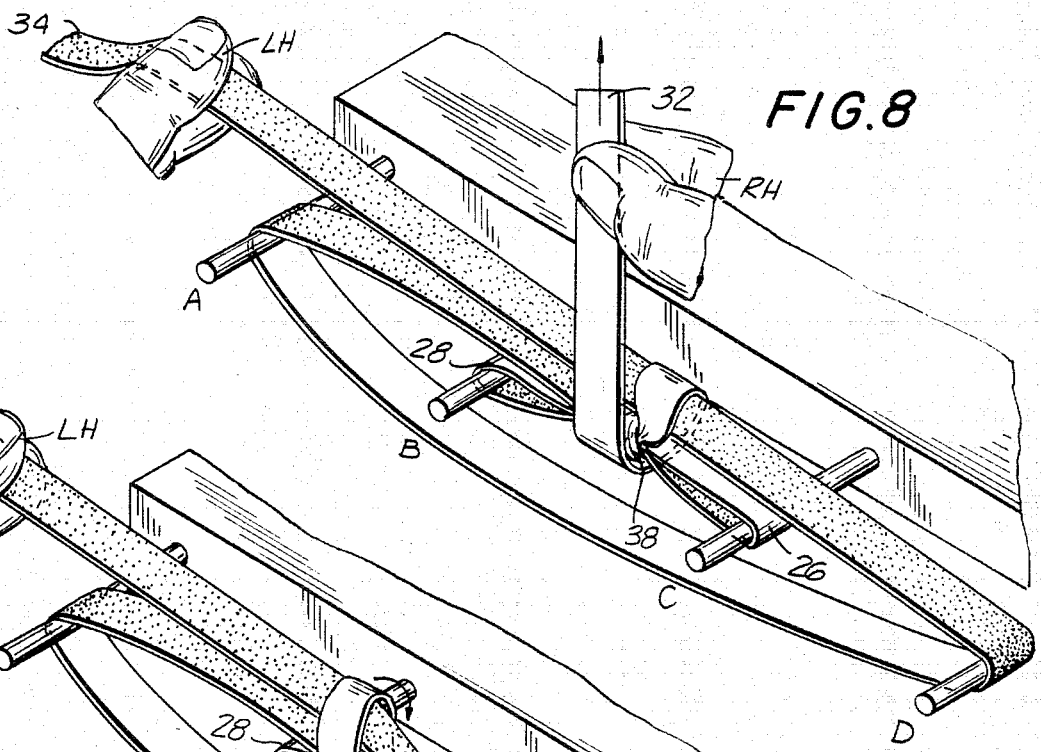
Figure 9:
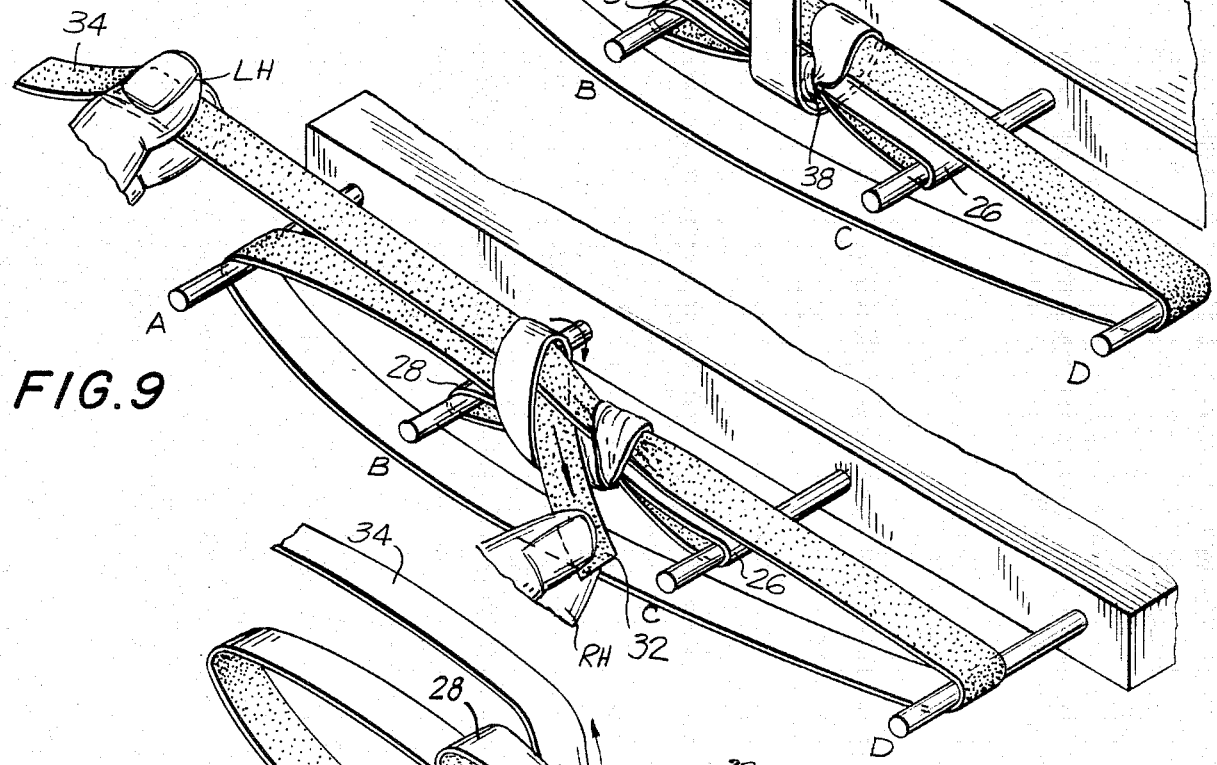

FIGS. 7–9 illustrate the formation of center knot 30 and adjustable loop 22. In FIG. 7, left ribbon tail 34 has been drawn around outer pins A and D of the jig with the rough side of ribbon 36 facing outward, i.e., with the smooth side of the ribbon contacting pins A and D. Left ribbon tail 34 is brought behind right ribbon tail 32.

In FIG. 8, right ribbon tail 32 is brought over left ribbon tail 34 and under bow knot 38 with the smooth side of ribbon 36 facing outward. As shown in FIG. 5, right ribbon tail 32 was brought out of the loop with the rough side facing upward. However, the smooth side of right ribbon tail 32 could be facing upward if desired and still form a finished bow with only smooth sides showing, as long as the smooth side of right ribbon tail 32 faces upward when the operation shown in FIG. 8 is performed. As shown in FIG. 8, right ribbon tail 32 is wrapped around bow knot 38 only once. However, in an alternative embodiment, right ribbon tail 32 can be wrapped around bow knot 38 a second time before tying center knot 30.

There are various ways in which center knot 30 can be tied such that left ribbon tail 34 is free to move for adjustment of loop 22. In FIG. 9, center knot 30 is formed by bringing right ribbon tail 32 over and then under left ribbon tail 34 and pulling ribbon tail 32 tightly to form center knot 30. Center knot 30 could also be formed after the step shown in FIG. 8 by inserting right ribbon tail 32 into the loop created by wrapping right ribbon tail 32 around bow knot 38, i.e., between the upward facing rough side of left ribbon tail 34 and the downward facing rough side of right ribbon tail 32. In the alternative embodiment where right ribbon tail 32 is wrapped around bow knot 38 twice, in order to form center knot 30, the right ribbon tail 32 can be tied under a either single or double thickness of right ribbon tail 32. In all cases, right ribbon tail 32 should be tied so that the rough side of the portion of right ribbon tail 32 which is pulled through to form center knot 30 faces upward in FIG. 9 so that in the final bow 20 only smooth surfaces face outwardly.

After center knot 30 has been formed, the bow 20 is taken off the jig and turned as shown in FIG. 10 so that the smooth surface of adjustable loop portion 22 is facing outwardly. Because of the way the bow has been formed, when adjustable loop 22 has been turned "right-side out," the outwardly facing surfaces of bow portion 24, including loops 26 and 28, center knot 30, and right and left ribbon tails 32 and 34, also have their smooth surfaces exposed.

Other modifications and variations will be apparent to those skilled in the art and the claims are intended to cover all such modifications and variations that fall within the true spirit and scope of the invention.

We claim:

1. An adjustable pull bow made of a single length of flexible material comprising a bow portion and an adjustable loop portion, the bow portion comprising a right bow loop and a left bow loop, a center knot between the right and left bow loops, a stationary tail, and an adjustable tail wherein the adjustable loop portion can be varied in size by pulling the adjustable tail through the center knot of the bow portion.

2. A method for making an adjustable pull bow made of single length of flexible material having a bow portion and an adjustable loop portion, the bow portion comprising a right bow loop and a left bow loop, a center knot between the right and left bow loops, a stationary tail, and an adjustable tail wherein the adjustable loop portion can be varied in size by pulling the adjustable tail through the center knot of the bow portion comprising the steps of:

(a) tying the stationary and adjustable tails to form the bow portion;

(b) bringing the adjustable tail into a loop centered on the bow portion; and (c) bringing the stationary tail around the bow portion and the adjustable tail to form the center knot such that the adjustable tail can be moved through the center knot allowing the size of the adjustable loop to be varied.

3. A method for making an adjustable pull bow made of single length of flexible material having a bow portion and an adjustable loop portion, the bow portion comprising a right bow loop and a left bow loop, a center knot between the right and left bow loops, a stationary tail, and an adjustable tail wherein the adjustable loop portion can be varied in size by pulling the adjustable tail through the center knot of the bow portion comprising the steps of:

(a) crossing the stationary tail of the flexible material over and behind the adjustable tail of the flexible material to form a first loop;

(b) bringing the stationary tail (1) under the first loop, (2) up in front of the first loop, and (3) to a side of and behind the adjustable tail to form a second loop;

(c) threading the stationary tail through the second loop and pulling the stationary and adjustable tails tightly to form a first knot, the first knot defining a right bow loop and a left bow loop;

(d) pulling the adjustable tail into a third loop starting and ending at the first knot;

(e) wrapping the stationary tail around the adjustable tail and the first knot;

(f) bringing the stationary tail behind the adjustable tail to form a fourth loop;

(g) threading the stationary tail through the fourth loop and pulling the stationary and adjustable tails tightly to form the center knot of the bow portion, the center knot defining the starting and ending points of the adjustable loop.

4. An adjustable pull bow made according to the method of claim 2.

5. The method of claim 3 wherein the adjustable tail is on the left hand side and the stationary tail is on the right hand side of the bow portion.

6. The method of claim 3 further comprising the steps of placing the adjustable loop portion around a package, pulling the adjustable tail to adjust the size of the adjustable loop portion around the package, and cutting the adjustable loop portion to a desired length.

* * * * *